United States Patent [19]

Park

[11] Patent Number: 4,903,353

[45] Date of Patent: Feb. 27, 1990

[54] APPARATUS FOR SUSPENDING BEDCLOTHES

[76] Inventor: Ki Dong Park, 920 H. Street, N.E., Washington, D.C. 20002

[21] Appl. No.: 284,330

[22] Filed: Dec. 14, 1988

[51] Int. Cl.[4] ..... A47C 21/02; A47C 21/04

[52] U.S. Cl. ..... 5/2 R; 5/505; 5/508; 5/421; 5/284; 128/376

[58] Field of Search ..... 5/2 R, 503, 505, 508, 5/504, 506, 414, 421, 284; 128/373, 376

[56] References Cited

U.S. PATENT DOCUMENTS

| | | | |
|---|---|---|---|
| 211,221 | 1/1879 | Cartter | 5/505 |
| 628,351 | 7/1897 | O'Neill | 128/373 |
| 649,900 | 5/1900 | Brennan | 5/505 |
| 649,901 | 5/1900 | Brennan | 5/505 |
| 664,081 | 12/1900 | Gohlin | 5/284 |
| 924,040 | 6/1909 | Collins | 5/505 |
| 1,106,474 | 8/1914 | Persson | 5/505 |
| 1,200,462 | 10/1916 | Brent | 5/505 |
| 1,361,812 | 12/1920 | Bolander | 5/505 |
| 1,675,207 | 6/1928 | Borland | 5/505 |
| 4,113,218 | 9/1978 | Linder | 248/291 |
| 4,242,810 | 1/1981 | Blanco | 34/98 |

FOREIGN PATENT DOCUMENTS

| | | | |
|---|---|---|---|
| 903433 | 10/1945 | France | 128/373 |
| 154551 | 5/1956 | Sweden | 5/505 |
| 120645 | 6/1927 | Switzerland | 128/373 |

*Primary Examiner*—Alexander Grosz
*Assistant Examiner*—Eric K. Nicholson
*Attorney, Agent, or Firm*—Birch, Stewart, Kolasch & Birch

[57] ABSTRACT

An apparatus for suspending bedclothing which comprises a rectangular cross frame, four supporting posts extending downwardly from corners of the rectangular cross frame, a pair of wires from the cross frame, grasping members connected to one ends of the chains, a pair of rods disposed in the underside of the bedclothes whereby the bedclothing hangs by the chains for relieving the occupant from the weight of the bedclothing and treating various regions of the body of the occupant on the bed. In addition, the occupant of the bed can used light emitting members which may operate as a sauna, and TV and video cassette sets supported by the supporting post thereof.

8 Claims, 2 Drawing Sheets

APPARATUS FOR SUSPENDING BEDCLOTHES

BACKGROUND OF THE INVENTION

1. Field of the Invention

The present invention relates to an apparatus for suspending bed clothes and more particularly, to an apparatus including a rectangular cross frame, and support members extending downwardly from four corners of the rectangular cross frame, and a pair of chains connected to the cross frames at one ends thereof, having grasping members at the other ends thereof, a pair of rods which can be put into the bedclothes for being grasped by the grasping members through the bedclothes. The present invention further relates to an apparatus including a plurality of light emitting members disposed in a housing which can be adjusted by means of manual for a sauna, and TV and video cassette sets suspended by the supports for being used by the user on a bed.

2. Description of the Prior Art

Many types of apparatuses for suspending bedclothes are known in the art which include a fixed frame which can be covered by bedclothes. However, it is very difficult to store in a room. Furthermore, the bedclothes may slip from the fixed frame.

In general, few types of apparatuses for suspending bedclothes exhibit satisfactory results. An example of a conventional apparatus is described in U.S. Pat. No. 649,900 to Brennan. An apparatus is disclosed which includes a pointed end of a needle that is drawn through the bedclothes from the inside to the outside thereof and inserted into a receiving socket connected to a suspension arm which is supported by a standard. Since the needle passes through the bedclothes, the bedclothes may be torn by repeatedly using. Furthermore, since the suspension arms are positioned across the bed, the bedclothes may be suspended over the several regions of the human body. That is, the bedclothes cannot be suspended along the human body.

SUMMARY OF THE INVENTION

Accordingly, it is an object of the present invention to provide an improved apparatus for suspending the bedclothing.

Another object of the present invention is to provide an apparatus including a pair of chains from cross frames, grasping members attached to the chains, and a pair of rod which are put into the inside of the bedclothing for being grasped by the grasping members through the clothing to relieve the occupant from the weight of the clothing, relieve various regions of the occupant's body on the bed, and prevent the bedclothing from slipping from the bed.

Another object of the present invention is to provide an apparatus including a rectangular cross frame and four supports from the corners of the rectangular cross frame, a housing containing a plurality of light emitting members for a sauna, and TV and video cassette sets suspended by the supports for the use of the occupant of the bed.

Yet another object of the present invention is to provide an apparatus for suspending an overquilt that is simple in construction, economical to manufacture, easily manipulated and attractive in appearance.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to an apparatus for suspending the bedclothing which comprises a rectangular cross frame, four supporting posts extending downwardly from corners of the rectangular cross frame, a pair of chains from the cross frame, grasping members connected to one ends of the chains, a pair of rods put into the underside of the bedclothes whereby the bedclothing is hung by the chains for relieving the occupant and treating various regions of the occupant's body while on the bed. In addition, the occupant of the bed can use the light emitting members for a sauna, and TV and video cassette sets supported by the supporting post thereof.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
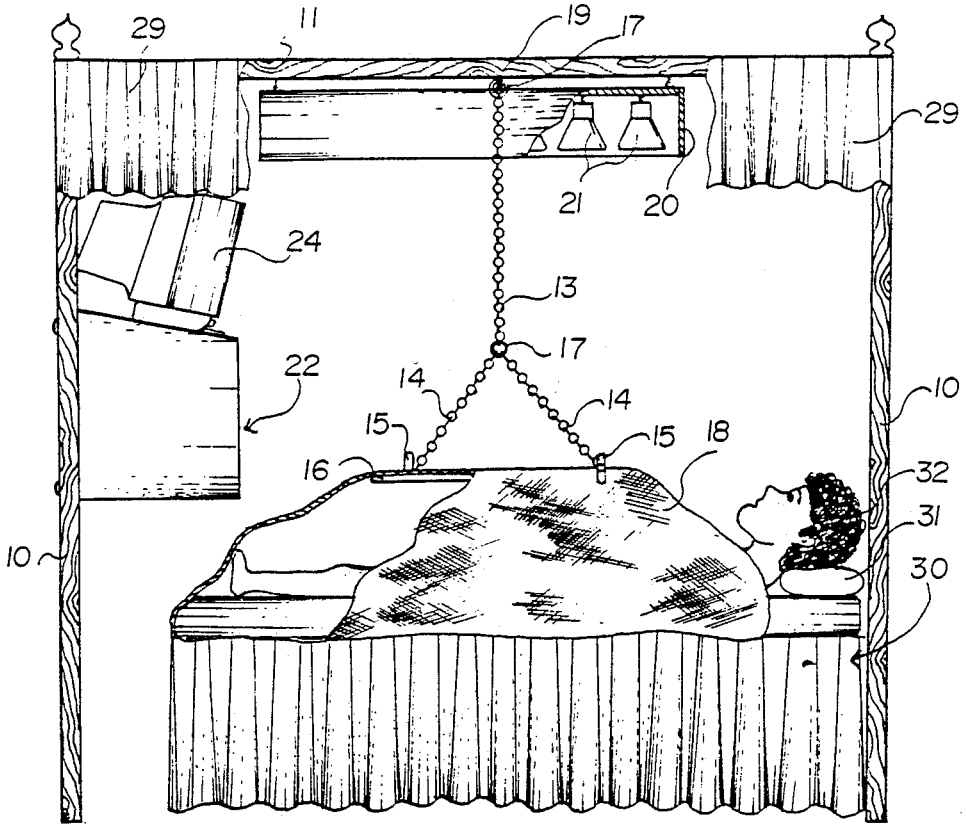
FIG. 1 is a side view of an apparatus according to the present invention showing the bedclothing suspended by the wires.
Figure 2:
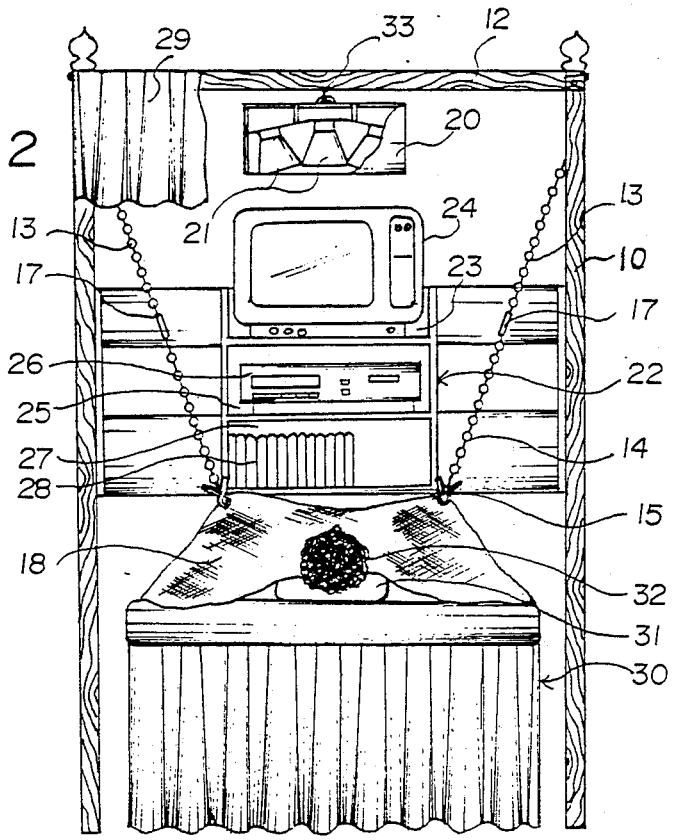
FIG. 2 is a front view of the apparatus according to the present invention showing the bedclothing suspended by the wires and the occupant of the bed watching and listening to a TV set and video cassette.

Referring now in detail to the drawings for the purpose of illustrating preferred embodiments of the present invention, the apparatus for suspending bedclothes as shown in FIGS. 1 and 2 comprises supporting posts 10, a rectangular cross frame having longitudinal frames 11 and transverse frames 12 supported by the supporting posts 10 at the corners, a pair of flexible members such as chains 13 extend from hooks 19 through rings 17 at ends thereof wherein, at the other ends thereof, the flexible members divide into a pair of divided flexible members such as chains 14 through rings 17, and grasping members such as tongs, tweezers, forceps, or nippers 15 are disposed at the ends of the divided flexible members 14. A pair of rods 16 are disposed in the underside of a bedclothing 18 for being grasped by the grasping members 15 through the bedclothing 18. Therefore, the occupant 32 lying on a bed 30 with a pillow 31 can be relieved and various regions of the body of the occupant 32 can be treated. Also, the bedclothing 18 cannot slip from the bed 30. It is preferred to use a specific bed such as a therapeutic bed which is disclosed in U.S. Pat. No. 4,769,864. The rod 16 can be adjusted by means of various conventional methods for controlling the length thereof about the height of the occupant 32 of the bed 30 (not shown).

Figure 3:
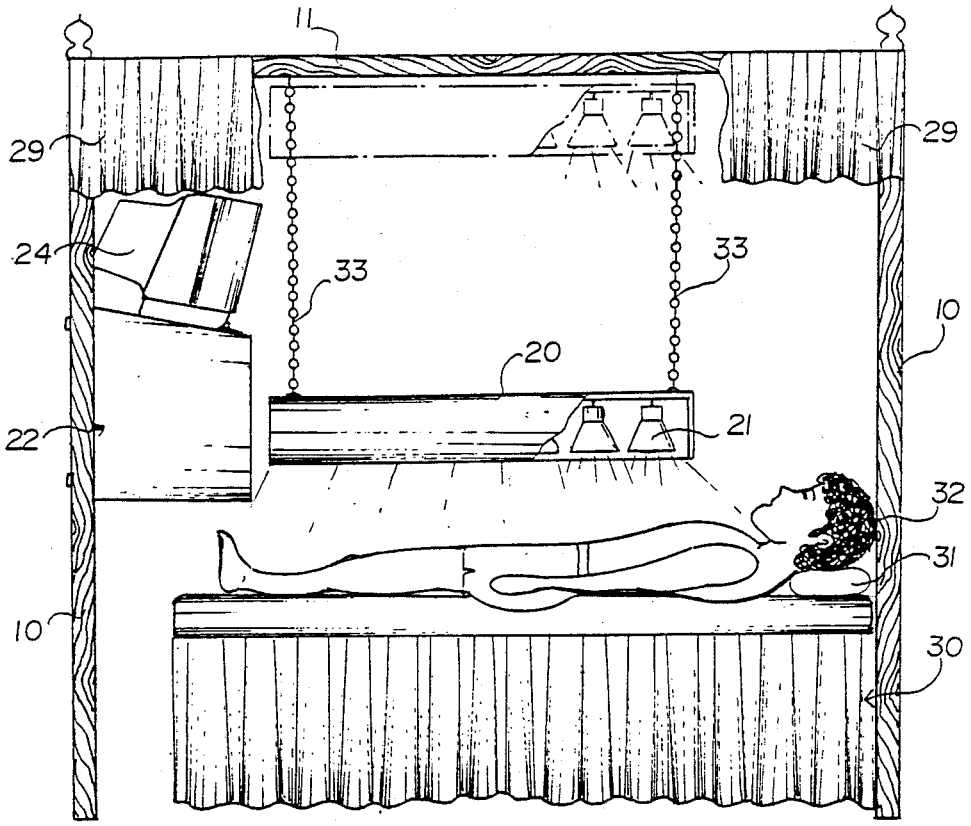
FIG. 3 is a side view of the apparatus according to the present invention showing the occupant of the bed in a sauna with a plurality of light emitting members of the apparatus.

Referring in detail to FIG. 3, there is illustrated an additional embodiment of an apparatus in accordance with the present invention. FIG. 3 is a side view to illustrate how a housing 20 contains a plurality of light emitting members such as lamps 21 directed downwardly for operation as a sauna. The housing 20 is operatively connected to the transverse frame 12 and hangs by a pair of flexible members such as ring chains 33 (FIG. 2). Accordingly, the height of the housing 20 can be adjusted by adjusting the ring chains 33 with hooks on the transverse frame 12 (FIG. 3). Also the housing 20 may contain three lines of lamps 21 wherein the side lamps are directed in a centerward direction for concentrating the light of the lamps 21 to the human body of the occupant 32 of the bed 30.

Figure 4:
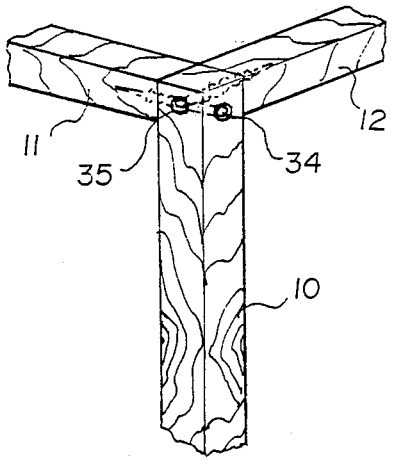
FIG. 4 is a perspective view of connecting means of a cross frame and a supporting post of the apparatus according to the present invention.

Referring in detail to FIG. 4, there is illustrated a frame construction in accordance with the present invention. FIG. 4 is a perspective view to illustrate how the frames are assembled. The supporting post 10 is mounted to the longitudinal frame 11 and the transverse frame 12 by screwed bolts 34 through apertures 35 disposed in the top portions of the supporting post 10, respectively.

As shown in FIG. 2, the rear supporting posts 10 are provided with several supports for forming shelves 23, 25, and 27. A TV set 24 is disposed on the top shelf 23, a video cassette set 24 is placed on the middle shelf 25, and many top cases 28 are placed on the lower shelf 27 for the occupant 32 to use them in a lying position on the bed 30. Curtains 29 may be provided for covering the housing 20 for a good appearance.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. An apparatus for suspending a bedclothing which comprises:

bed frame support means, a pair of flexible members connected to said bed frame support means, said flexible members dividing into a pair of divided flexible members, respectively, grasping means mounted to the ends of said divided flexible members, respectively, a housing containing a plurality of light emitting members, said housing being adjustably suspended by flexible members to said bed frame support means for upwardly moving from and downwardly moving to the occupant of the bed to operate as a sauna, and a TV set and a VCR set supported by said bed frame support means for being used by the occupant of bed, whereby the bedclothing hangs by the flexible members to suspend the bedclothing for relieving an occupant of a bed from the weight of the bedclothing and treating various regions of the human body of the occupant.

2. The apparatus of claim 1, wherein the bed frame support means includes supporting posts and a pair of longitudinal and transverse frames supported by said supporting post at the corners thereof which are formed by said pair of longitudinal and transverse frames.

3. The apparatus of claim 1, wherein the flexible members are ring chains.

4. The apparatus of claim 1, wherein the grasping means is a member selected from the group consisting of tongs, tweezers, forceps, and nippers.

5. The apparatus of claim 1, wherein the light emitting member are lamps.

6. The apparatus of claim 1, wherein the housing contains three lines of light emitting members wherein both side lines of light emitting members are directed to a center direction for concentrating the light of the light emitting members to the occupant of the bed.

7. The apparatus of claim 2, wherein the housing is adjustably connected to said transverse frames.

8. The apparatus of claim 1, wherein the flexible members are chains.

* * * * *